US009150327B2

(12) United States Patent
Begim

(10) Patent No.: US 9,150,327 B2
(45) Date of Patent: Oct. 6, 2015

(54) FOLDING BOX WITH REMOVABLE HANDLE

(71) Applicant: Moshe Yair Begim, East Rancho Dominguez, CA (US)

(72) Inventor: Moshe Yair Begim, East Rancho Dominguez, CA (US)

( * ) Notice: Subject to any disclaimer, the term of this patent is extended or adjusted under 35 U.S.C. 154(b) by 0 days.

(21) Appl. No.: 14/010,445

(22) Filed: Aug. 26, 2013

(65) Prior Publication Data

US 2013/0341382 A1 Dec. 26, 2013

Related U.S. Application Data

(63) Continuation-in-part of application No. 13/869,867, filed on Apr. 24, 2013.

(60) Provisional application No. 61/638,156, filed on Apr. 25, 2012.

(51) Int. Cl.

| | |
|---|---|
| ***B65D 5/46*** | (2006.01) |
| ***B65D 5/54*** | (2006.01) |
| ***B65D 5/42*** | (2006.01) |
| ***B65D 5/20*** | (2006.01) |
| *B65D 5/22* | (2006.01) |

(52) U.S. Cl.

CPC ..... *B65D 5/4208* (2013.01); *B65D 5/2076* (2013.01); *B65D 5/4204* (2013.01); *B65D 5/46096* (2013.01); *B65D 5/54* (2013.01); *B65D 5/546* (2013.01); *B65D 5/547* (2013.01); *B65D 5/22* (2013.01)

(58) Field of Classification Search

CPC ..... B65D 5/2076; B65D 5/22; B65D 5/4208; B65D 5/46128; B65D 5/546; B65D 5/547

USPC ..... 229/117.13, 117.14, 117.18, 221, 223, 229/228, 160.2, 162.1; 206/806

See application file for complete search history.

(56) References Cited

U.S. PATENT DOCUMENTS

| | | | | |
|---|---|---|---|---|
| 1,223,013 | A | 4/1917 | Wilson | |
| 1,749,771 | A | 3/1930 | Levey | |
| 2,323,746 | A | 7/1943 | Woolf | |
| 2,949,151 | A | 8/1960 | Goldstein | |
| 2,993,590 | A | 7/1961 | Denton | |
| 3,092,298 | A * | 6/1963 | Scholle | 229/160.2 |
| 3,185,295 | A | 5/1965 | Crane | |
| 3,486,615 | A | 12/1969 | De Woskin | |
| 3,523,403 | A | 8/1970 | Collins | |
| 3,540,354 | A | 11/1970 | Tachibana | |

(Continued)

FOREIGN PATENT DOCUMENTS

| | | | |
|---|---|---|---|
| DE | 9419978.7 U1 * | 12/1994 | B65D 5/4208 |
| GB | 1142773 | 2/1969 | |

*Primary Examiner* — Gary Elkins

(74) *Attorney, Agent, or Firm* — Edwin Tarver; Lauson & Tarver, LLP

(57) ABSTRACT

A box folded from a single cardboard sheet includes two handle members incorporated into the cardboard sheet. The box includes a first handle member removably attached near a top panel of the enclosure portion of the box, and a second handle member removably attached to the rear panel of the box. When the cardboard sheet is folded to assemble the box, the first handle member and second handle member come together in an overlaying configuration to form a box handle. Holes in the handle members form a structure through which users may insert their fingers for carrying the box, and a perforated area, allows the handle to be easily separated from the box leaving a flap to overlay or be tucked in the box.

9 Claims, 10 Drawing Sheets

(56) References Cited

U.S. PATENT DOCUMENTS

| | | | | | |
|---|---|---|---|---|---|
| 3,624,236 | A | | 11/1971 | Frappier | |
| 3,635,451 | A | | 1/1972 | Wagner | |
| 3,864,200 | A | * | 2/1975 | Marshall | 229/120 |
| 3,946,936 | A | | 3/1976 | Brown | |
| 3,972,270 | A | | 8/1976 | Marshall | |
| 4,030,662 | A | | 6/1977 | Gess | |
| 4,235,336 | A | | 11/1980 | Dudas | |
| 4,261,462 | A | | 4/1981 | Wyxocki | |
| 4,266,671 | A | * | 5/1981 | Roccaforte | 229/223 |
| 4,485,920 | A | | 12/1984 | Skylvik | |
| 4,518,086 | A | | 5/1985 | Roccaforte | |
| 4,842,141 | A | | 6/1989 | Segal | |
| 4,949,845 | A | * | 8/1990 | Dixon | 206/806 |
| 5,018,637 | A | * | 5/1991 | Miller | 229/160.2 |
| 5,263,586 | A | * | 11/1993 | Keable | 206/469 |
| 5,566,831 | A | * | 10/1996 | Swenson | 206/806 |
| 5,620,134 | A | | 4/1997 | Gulliver | |
| 5,704,481 | A | | 1/1998 | Lutz | |
| 6,050,415 | A | | 4/2000 | Lind | |
| 6,276,529 | B1 | | 8/2001 | Feehan | |
| 6,308,832 | B1 | | 10/2001 | Pirro | |
| 6,375,010 | B1 | * | 4/2002 | Thibault | 206/806 |
| 6,523,689 | B2 | | 2/2003 | Mickel | |
| 6,571,953 | B2 | | 6/2003 | Sherline | |
| 6,676,584 | B2 | | 1/2004 | Tachikawa | |
| 6,739,453 | B1 | | 5/2004 | Mazurek | |
| 6,808,106 | B1 | | 10/2004 | Grigsby | |
| 7,051,876 | B2 | | 5/2006 | Grosskopf | |
| D556,565 | S | | 12/2007 | Nazari | |
| 7,399,267 | B2 | | 7/2008 | Moen | |
| 7,571,810 | B2 | | 8/2009 | Tilton | |
| 7,681,733 | B2 | | 3/2010 | Grosskopf | |
| 7,726,480 | B2 | | 6/2010 | Nazari | |
| 7,726,481 | B2 | | 6/2010 | Grosskopf | |
| D621,695 | S | | 8/2010 | Van Solkema | |
| 7,882,950 | B2 | | 2/2011 | Nazari | |
| 8,066,177 | B2 | | 11/2011 | Tanaka | |
| 8,091,704 | B2 | | 1/2012 | Trigg | |
| 8,205,746 | B2 | | 6/2012 | Nazari | |
| 8,205,747 | B2 | | 6/2012 | Nazari | |
| 2001/0015374 | A1 | | 8/2001 | Schultz | |
| 2001/0022318 | A1 | | 9/2001 | Kaden | |
| 2007/0125678 | A1 | | 6/2007 | Green | |
| 2007/0187273 | A1 | | 8/2007 | Grosskopf | |
| 2008/0029417 | A1 | | 2/2008 | Begim | |
| 2008/0142393 | A1 | | 6/2008 | Grosskopf | |
| 2010/0133331 | A1 | * | 6/2010 | Sorrentino et al. | 229/162.1 |
| 2010/0236963 | A1 | * | 9/2010 | Nazari | 206/462 |
| 2011/0198393 | A1 | | 8/2011 | Bates | |

* cited by examiner

FOLDING BOX WITH REMOVABLE HANDLE

This application is a continuation-in-part of, and claims the benefit of the priority filing date of application Ser. No. 13/869,867, filed on Apr. 24, 2013, which claims the benefit of the priority date of provisional application No. 61/638,156, filed on Apr. 25, 2012.

BACKGROUND

Blister packaging for small electronics goods is well known. One type of such display packaging consists of a pair of corrugated cardboard sheets joined together with a clear PVC plastic insert showing the product, and is popular with manufacturers and consumers. Consumers can see the product when contemplating a purchase, and for manufacturers the double cardboard layer package is rugged for protecting the product during shipping, and the sealed edges provide tamper resistance. See, for example, Nazari, U.S. Pat. No. 7,726,480.

There are environmental concerns with this popular type of packaging, however, as the cardboard and plastic portions are individually recyclable but must be separated for recycling. Even if designed to be separable, most consumers fail to make the effort. This is because the packaging is typically difficult to open and so consumers resort to using a knife or scissors to cut the plastic portion and extract the product, leaving the plastic and cardboard together upon disposal. Accordingly, a better package is needed for displaying the product in a tamperproof fashion and that is environmentally friendly, as well as inexpensive to make.

Another issue with blister packaging for consumer products, having two sheets of corrugated cardboard and a clear plastic container sandwiched between them, is that this type of conventional packaging uses hot melt glue typically applied by hand and difficult to control due to the drying time and placement of the glue. Also, the corrugated sheets of the cardboard are visible on the side edges of the finished packaging which is aesthetically unappealing.

Other conventional blister packaging uses one sheet of corrugated cardboard and one or two flat sheet of paper, adhered together by adhesive. Since only one cardboard sheet is used, this type of packaging sometimes lacks sufficient structural strength when multiple display packs are stood on their sides in a container. When the weight of the top package is supported directly by the packs in the bottom bundle, they must have sufficient structural strength and rigidity to prevent them from bending.

Folding cardboard boxes are known in the art, including folding display cardboard boxes made of a single cardboard sheet. Displays of these types of packages may be stacked, but are typically hung on pegs or similar display structures for ease of installation and retrieval by users. One benefit of hanging packaging of this type is that a handle may be incorporated into the package, allowing a user to easily carry it after purchase, obviating the need for a bag.

One example of this type of packaging was disclosed in U.S. patent application Ser. No. 13/869,867 for a Display Cardboard Folded Package with Periphery Sealed Edges, of which this application is a continuation-in-part. A manufacturing benefit of such packaging is that it can be easily constructed from a single cardboard sheet. Although formed by a single sheet, product packaging must be able to function as an attractive container for a product prior to purchase, and should ideally be able to serve as a container for a product for storage and other purposes alter purchase.

Notably, the handle portion of this type of folding packaging, frequently becomes superfluous once the package is brought home from a store. Additionally, the handle makes the package difficult to manage since it presents a physical obstacle when trying to organize or arrange multiple packages tightly together. For this reason, there is a need for a folding display package made from a single sheet of cardboard, which has a handle for displaying and carrying the package, but which also may be removed to form a conventionally shaped box.

SUMMARY

A package for a product includes a single sheet having one side with an image of the product printed thereon and an opposing blank side. The sheet is foldable into a shell having a rear opening, and the shell is sized to receive the product inside the shell through the opening. The shell has a front panel with an image of the product. The sheet further includes a top panel next to the shell, a rear panel to cover the shell, and the shell has outer edges adhered to outer edges of the rear panel, so that the product may be placed inside the shell and is sealed inside the package. The package has crushed edges around a majority of the perimeter of the package.

In various embodiments, the rear panel may extend to cover the top panel. The sheet is preferably made of corrugated cardboard, including a cut-out in the top panel corresponding to a cut-out the rear panel, for forming a handle for the package. Preferably the sheet includes a crushed area between the outer edges of the shell and the outer edges of the rear panel.

To create the shell, the foldable sheet includes a first set of opposing side panels and a second set of opposing side panels adjoining a front panel, the front panel bearing an image of the product. The second set of opposing side panels includes tabs disposed distally from the front panel, and when the sheet is folded such that the tabs and the top panel align with the rear panel to form a common peripheral edge, an enclosure for the product is formed.

To form the package, a single sheet of foldable material is provided and an image of the product printed on only one side of the sheet. The sheet is folded to create a shell sized to hold the product and a top panel, and folded to create a rear panel for enclosing the shell and covering the top panel. The outer edges of the rear panel are adhered to corresponding outer edges of the top panel and the outer edges of the shell, and the outer edges are crushed. A product may be inserted into the shell prior to the adhering the outer edges together, and adhesive may be applied between the rear panel and the top panel inward of the outer edges. To form a handle for hanging or carrying, holes may be formed in the top panel and correspondingly through the rear panel.

In another embodiment, a box for a product is made from a single sheet of corrugated cardboard foldable into an enclosure with a rear opening. The enclosure is sized to receive the product through the rear opening, and the product may be arranged and visibly seen through a window formed in the box. The window can be of clear cellophane or a similar plastic material, or in some embodiments omitted altogether. The sheet of corrugated cardboard is also foldable into a rear panel for covering the rear opening, thereby forming a complete and sealable enclosure.

For displaying the box in an attractive manner and to conveniently carry the box, a series of handle members are incorporated into the cardboard sheet. The enclosure includes a first handle member removably attached, near a top panel of the enclosure, and the rear panel includes a second handle member removably attached to the rear panel. When the cardboard sheet is folded, the first handle member and second handle member come together in an overlaying configuration to form a box handle. Holes in the handle members form a structure through which users may insert their fingers for carrying the box.

The first handle member and second handle member are attached to the enclosure and rear panel, respectively, by a perforated area, allowing them to be easily separated. The first handle member is attached to the top of the box so that by pulling it away from the box, a clean line of separation is created at the edge of the enclosure. In contrast, the second handle member is attached to the rear panel so that when second handle is removed, a flap overhanging the enclosure is created. In this manner, when the handle is removed, the flap may be tucked into the enclosure so that no part of the cardboard sheet extends away from the box.

In various embodiments, the outer edges between the first handle member and second handle member may be crushed and glued together. Also, the enclosure may be crushed at the edge of the window. Since the flap, once tucked into the enclosure, may make opening the rear panel difficult, the rear panel may include a finger hole for pulling open the package.

To create the box with a removable handle, a single sheet of foldable material is first obtained. The sheet is preferably die-cut into a predetermined shape having fold lines for creating the enclosure, including various flaps for forming the enclosure in a desired shape, and a rear panel which may have side flaps. Using the flaps and fold lines, an enclosure and a roar panel are created. At this stage a product may be introduced into the box.

A first handle member is attached to the enclosure, and a second handle member is attached to the rear panel. These handle members are overlaying, sized to have a common periphery, and when brought together form the completed handle. Ideally, holes formed in the handle members come together to form a single hole for accommodating a user's fingers. Preferably, the handle members are formed on top of the box for hanging and carrying.

In order to make the handle removable, perforations are formed along a line between the enclosure and the first handle member, and along a line between the second handle member and rear panel. The perforations alone the second handle member are formed such that when removed, the second handle member leaves a flap overhanging the enclosure. In one embodiment, the perforations may end at the hole in the handle for ease of removal and to create a clean line.

Preferably, once the product is inserted into the enclosure and the box closed, the handle members are adhered together. To aid in adhering the handle members together, an adhesive may be applied between the handle members, including around the peripheral edges of the handle members. In this manner, the peripheral edges of the handle may be crushed to form a tamper-resistant and attractive display package.

REFERENCE NUMERALS

10. Package
12. Foldable Sheet
14. Graphic Representation of a Product
18. Tabs
20. Cut-Out Portion
27. Printed Side
24. Top Panel
26. Front Panel
28. First Side Panel
30. Second Side Panel
32. Third Side Panel
34. Fourth Side Panel
36. Flap
40. Indented Fold Lines
44. Rear Panel
50. Blank Side
52. Peripheral Edge
54. Crushed Area
110. Box
112. Handle
114. Front Tab
116. Rear Tab
118. Hole
120. Window
122. Perforations
124. Crease Line
126. Top Panel
128. Flap
130. Sides
132. Top Edge
134. Finger Hole
136. Enclosure
138. Wall Portion
140. Anchor Portion
142. Lid Portion
144. Central Panel
146. Side Flaps
148. Indicia

DESCRIPTION

Figure 1:
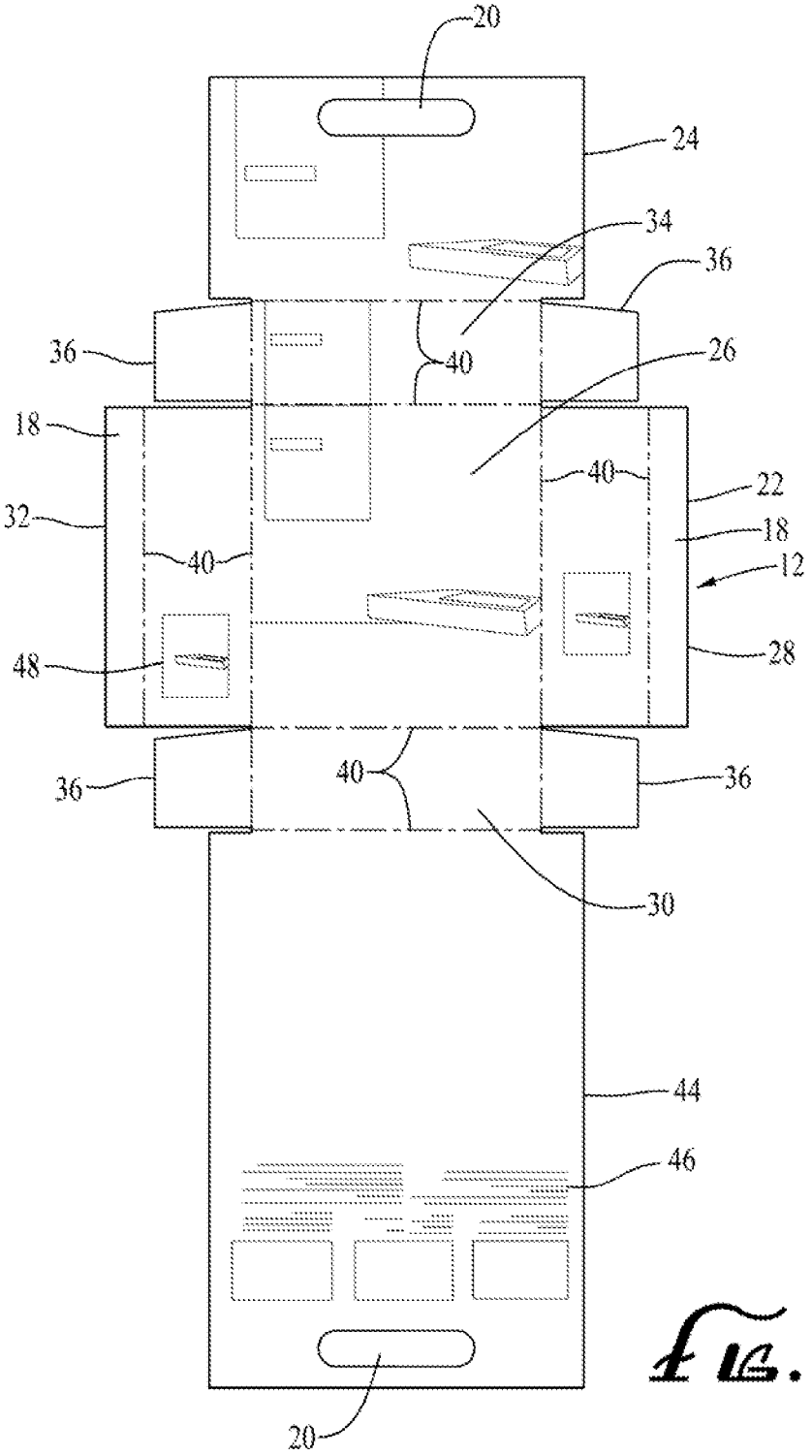
FIG. 1 is a plan view, flat pattern of the printed side of a cardboard sheet.

FIG. 1 is a plan view of a foldable sheet 12, showing the printed side 22 of the foldable sheet. The foldable sheet 12, which is preferably made of cardboard, but may be made of any substantially flat foldable material, includes a front panel 26 and four side panels 28, 30, 32 and 34, referred to as first through fourth side panels, respectively. Flaps 36 are attached to the four side panels 28, 30, 32 and 34 to prevent gaps when the foldable sheet 12 is folded. In the illustrated embodiment, tour side flaps 36 are attached to opposite ends of the second side panel 30 and fourth side panel 34, which are themselves on opposite sides of the front panel 26. In other embodiments, the flaps 36 may be disposed on opposite sides of the first side panel 28 and third side panel 32, or a single flap 36 may be disposed on each of the four side panels 28, 30, 32 and 34 as desired.

Still referring to FIG. 1, the first side panel 28 and third side panel 32 each have a tab 18 affixed opposite the front panel 26. The second side panel 30 has a rear panel 44 affixed opposite the front panel 26, and the fourth side panel 34 has a top panel 24 affixed opposite the front panel 26. Preferably, the foldable sheet 12 may be creased, or otherwise constructed such that the front panel 26, side panels 28, 30, 32 and 34, flaps 36, tabs 18, rear panel 44 and top panel 24 tend to fold along predetermined indented fold lines 40, which govern the shape of a package (not shown) formed from the foldable sheet 12.

Figure 2:
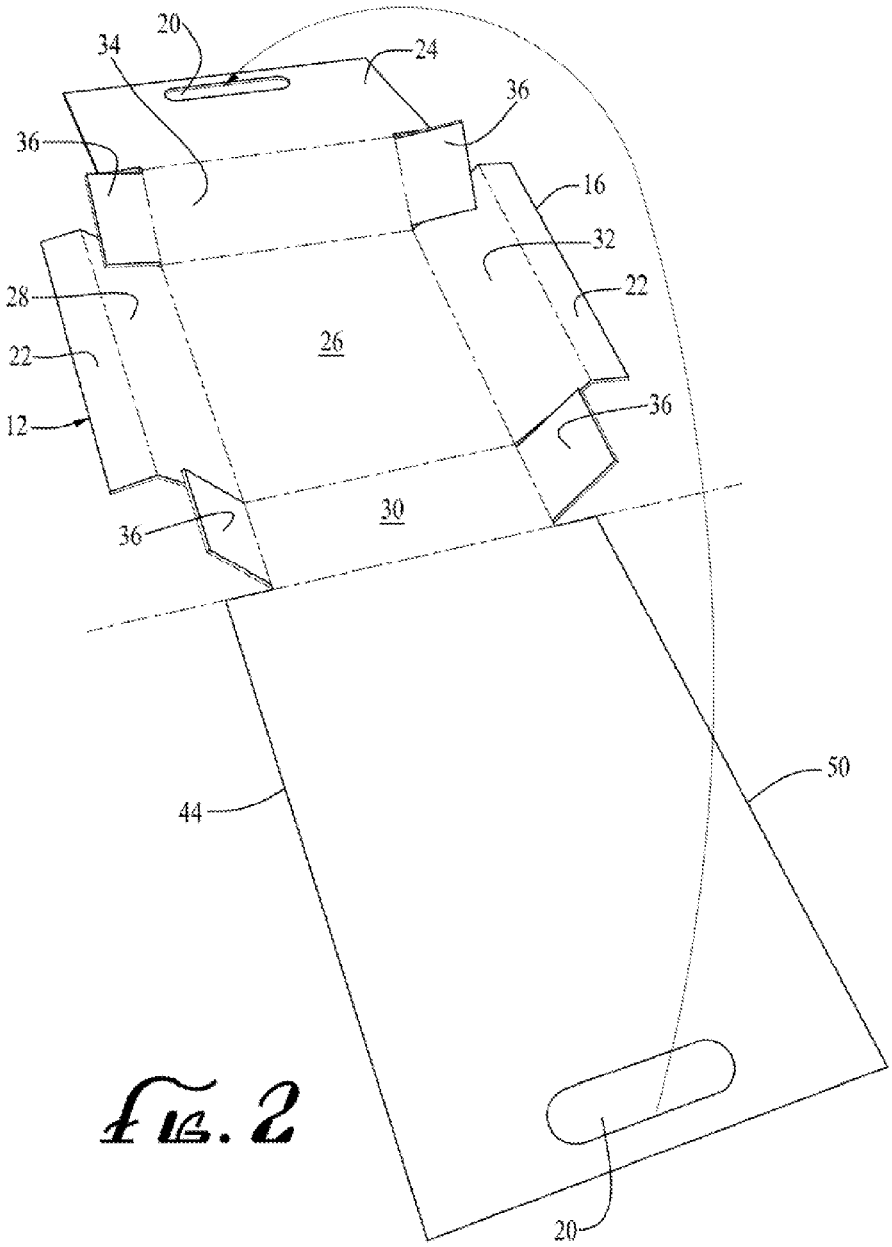
FIG. 2 is a perspective view of the blank side of the cardboard sheet.

FIG. 2 shows a perspective view of the blank side 50 of the foldable sheet 12 in preparation for folding. In order to form a package (not shown), the side panels 28, 30, 32 and 34 are folded relative to the front panel 26 to have a shell-like appearance, with the flaps 36 folded inward of the side panels 28, 30, 32 and 34, as shown. The rear panel 44 may then be folded over to engage the tabs 18 and top panel 24. In this manner, the blank side 50 of the foldable sheet 12 always forms the interior of a package (not shown), while the printed side 22 of the foldable sheet 12 always forms the exterior of a package.

Figure 3:
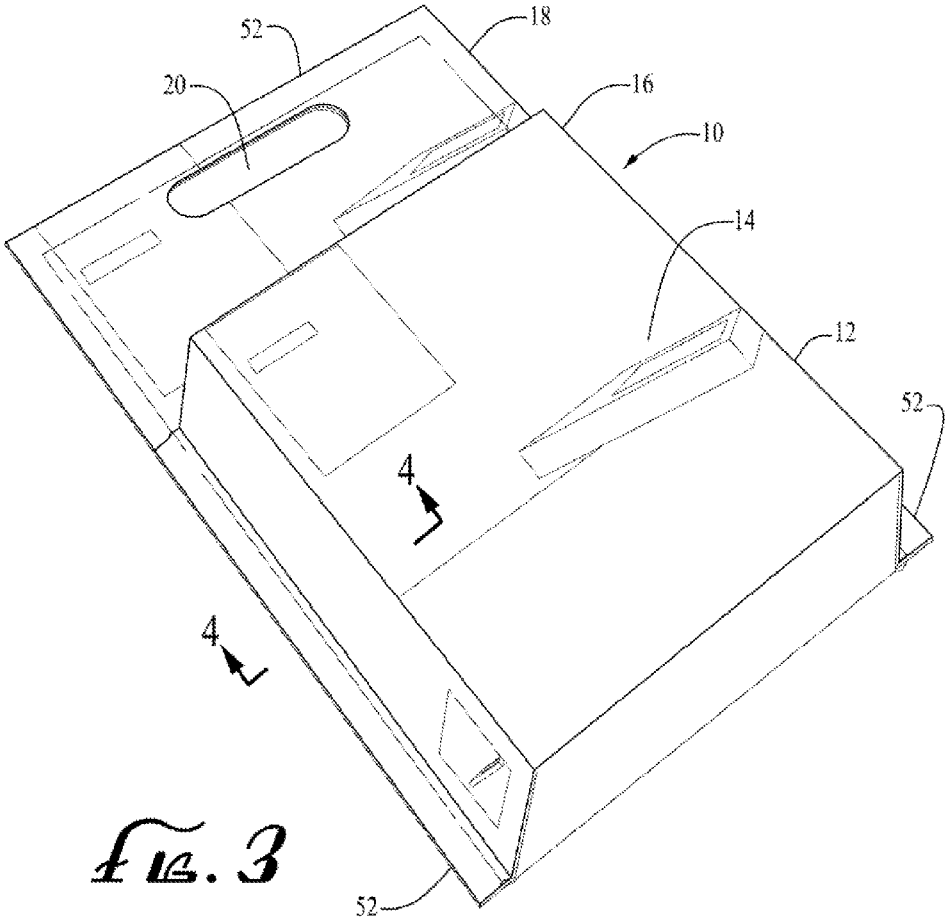
FIG. 3 is a perspective view of the cardboard sheet folded into a package.

FIG. 3 is a perspective view of the foldable sheet 12 fully assembled into a sealed package 10 with a graphic representation of a product 14. When the foldable sheet 12 is folded together to form a package 10, the shell-like structure formed by the front panel 26, side panels 28, 30, 32 and 34, the tabs 18 and the top panel 24 form a uniform peripheral edge 52. The peripheral edge 52 may be characterized as an area extending from the extreme edge of the foldable sheet 12 approximately a half an inch inward from the extreme edge. Additionally, cut-out portions 20 on the sheet 12 (shown in FIGS. 1 and 2) may align to form a handle for hanging or carrying the package 10. Since the printed side 22 of the sheet 12 is on the exterior of the package 10, it may show graphics 14, including images of items enclosed by the package 10.

Figure 4:
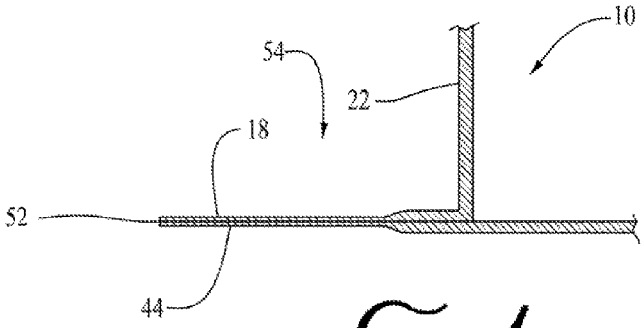
FIG. 4 is a partial cross-section view through the side of the package.

FIG. 4 shows a cross section view through the side of the package 10 of FIG. 3. Once a product (not shown) is packaged inside an assembled package 10, a crushed area 54 may be formed inward of the peripheral edge 52. The crushed area 54 may comprise an adhesive (not shown) to facilitate sealing of the package 10, and the adhesive may also extend beyond the crushed area 54 depending on the amount of adhesion desired. By heat seal coating the crushed area 54 prior to applying heat and pressure, the peripheral edge 52 may sealed to provide a tamper-resistant package 10 along with an attractive peripheral edge 52 of minimal thickness.

Typically adhesive (not shown) should be strong enough so the package 38 will stay sealed in transit and while hanging on a peg (not shown), but weak enough so that it can be opened by a consumer. Additionally, a variety of sealants are contemplated, including heat seal, cold seal, glue, etc. Preferably, the foldable sheet 10 is entirely made of recyclable and recycled cardboard. With a graphic 14, including a photograph or image of the product printed on the package 10, customers can see what they're buying before the purchase occurs.

Referring to FIGS. 5-11, another embodiment of the folding package is shown having a removable handle.

Figure 5:
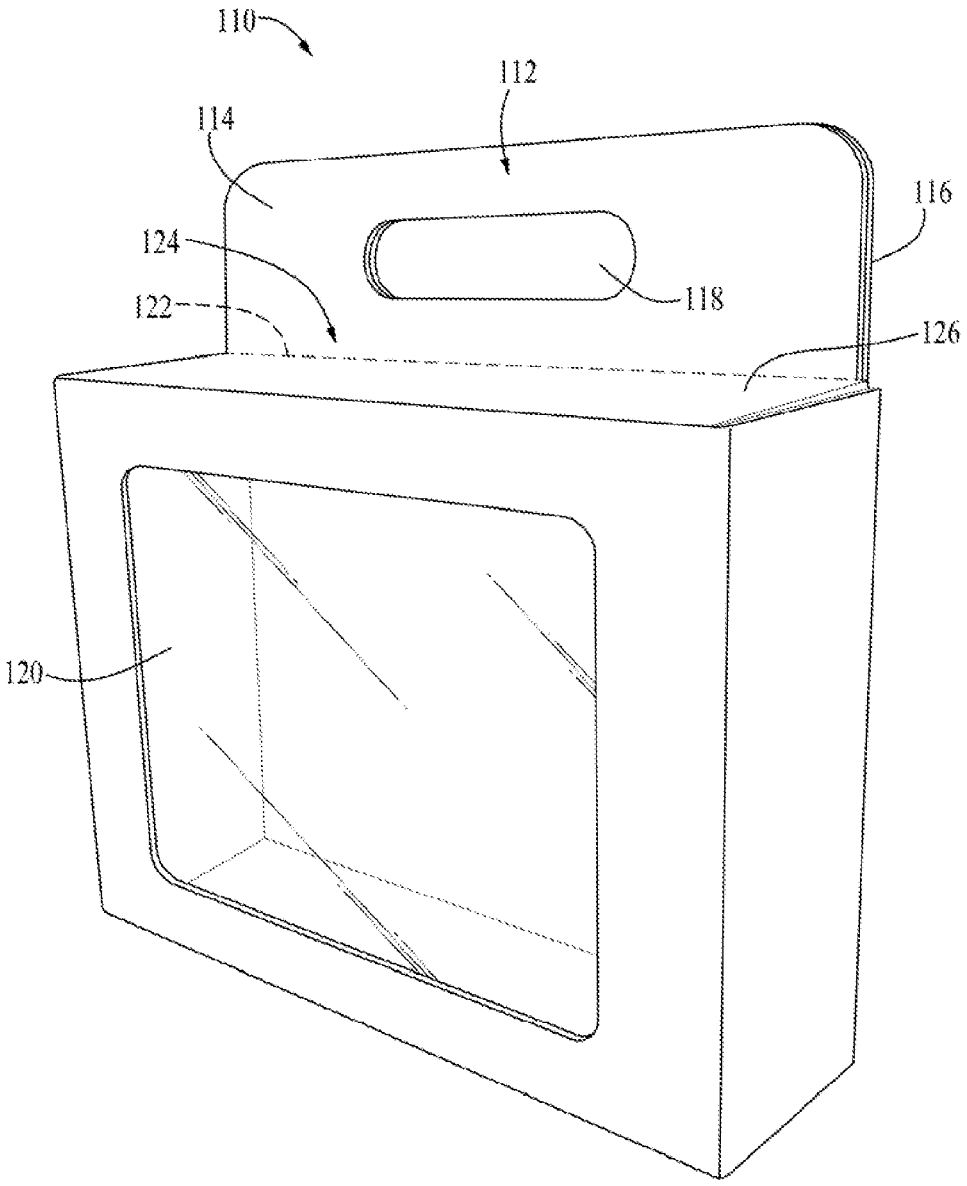
FIG. 5 is a perspective front view of a box having a detachable handle.

Referring to FIG. 5, a box 110 formed from a single sheet of cardboard includes a handle 112 formed from a front tab 114 and a rear tab 116. The front tab 114 and rear tab 116 are complimentary and arranged in an overlaying pattern, so that when the box 110 is assembled, a hole 118 for accommodating a user's fingers (not shown) is formed. The handle 112 is also adapted to allow the box 110 to be hung so that items (not shown) contained in the box 110 can be seen through a window 120 incorporated into the box. Also visible in FIG. 1 are a series of perforations 122 that allow a user to remove the front tab 114, disposed along a crease line 124 between the front tab 114 and top panel 126 of the box 110. In one embodiment, the peripheral edge formed by the front tab 114 and rear tab 116 may be crushed to present a tamper resistant and attractive appearance.

Figure 6:
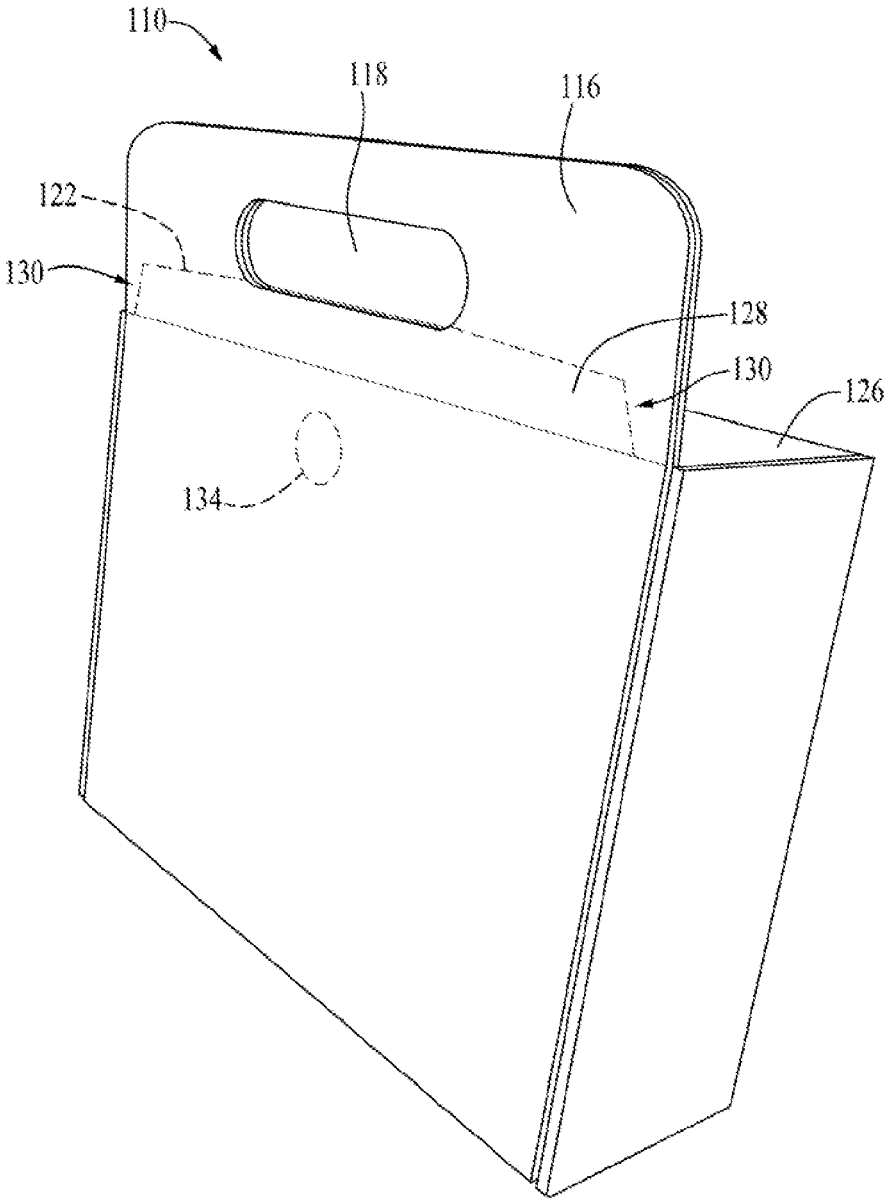
FIG. 6 is a perspective rear view of a box having a detachable handle.

Referring to FIG. 6, the box 110 is shown from behind so that the rear tab 116 is visible. In this view, perforations 122 along the rear tab 116 show where the rear tab 116 is removed from the box 110. Notably, perforations 122 on the rear tab 116 do not run along a crease line 124 (see, FIG. 1). Rather, the perforations 122 on the rear tab 116 form a pattern for creating a flap 128.

The flap 128 pattern preferably includes two sides 130 that encroach into the rear tab 116, and a top edge 132 running substantially the length of the rear tab 116. Also, in one embodiment, the bottom of the hole 118 is incorporated into the flap 128 pattern, avoiding the need for perforations 122 along the entire flap 128. Also shown in FIG. 6 is a finger hole 134, which is created by a circular perforated area and may be punched out and used as a manner of opening and closing the box 110 once the front tab 114 and rear tab 116 are removed.

Figure 7:
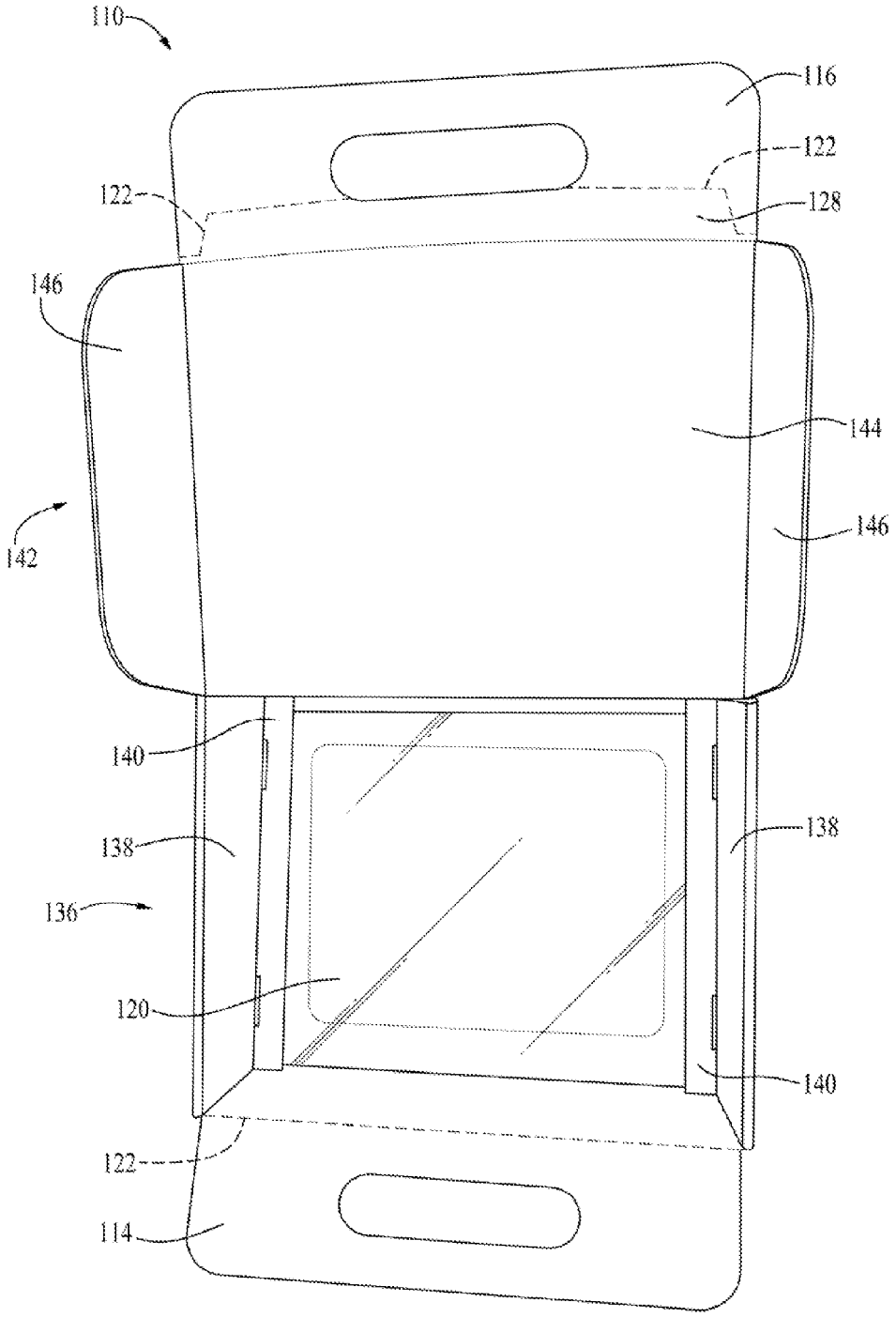
FIG. 7 is a perspective view of a box with a detachable handle in an open configuration.

Referring to FIG. 7, the box 110 is shown in an open configuration. In this view, the single panel construction of the box 110 is evident. An enclosure 136 of the box 110 is formed by a series of wall portions 138 and anchor portions 140, and includes the window 120. The front tab 114 is attached to the enclosure 136 along a common edge bearing perforations 122. In this manner, when the front tab 114 is removed along the perforations 122, the enclosure of the box 110 remains intact.

Still referring to FIG. 7, the box 110 includes a lid 142. The lid 142 includes a central panel 144 hingedly attached to the enclosure 136 thereby forming a rear opening. The central panel 144 also includes side flaps 146 and the rear tab 116 is incorporated into it between them. Also visible on the central panel 144 are the perforations 122 that allow the rear tab 116 to be removed by a user. As shown, the perforations 122 are arranged to create a flap 128 which remains after the rear tab 116 is removed. After removal, the flap 128 may be creased relative to the remaining portion of the lid 142 to create a hinged connection for tucking the flap 128 into the closed box 110.

Figure 8:
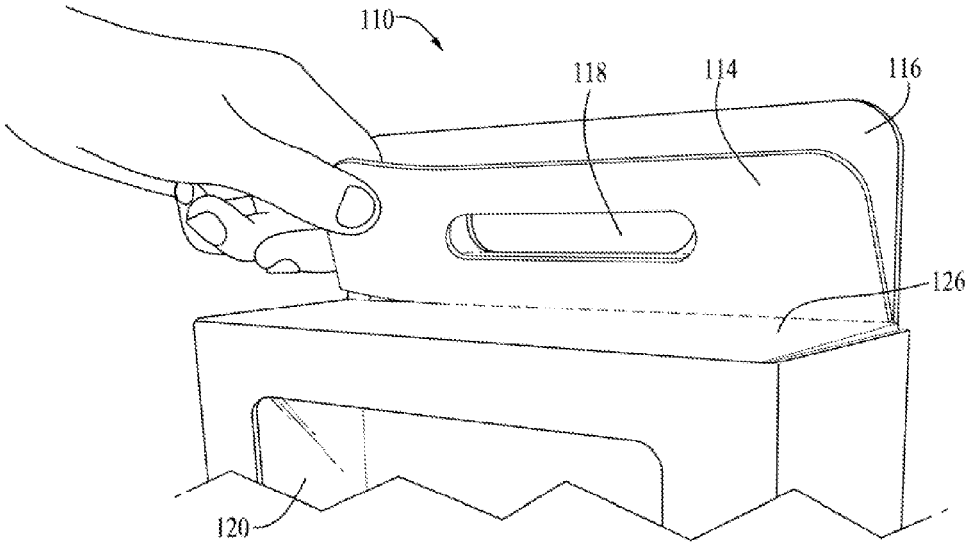
FIG. 8 is a perspective view of a box with a detachable handle, with the front tab being removed.
Figure 9:
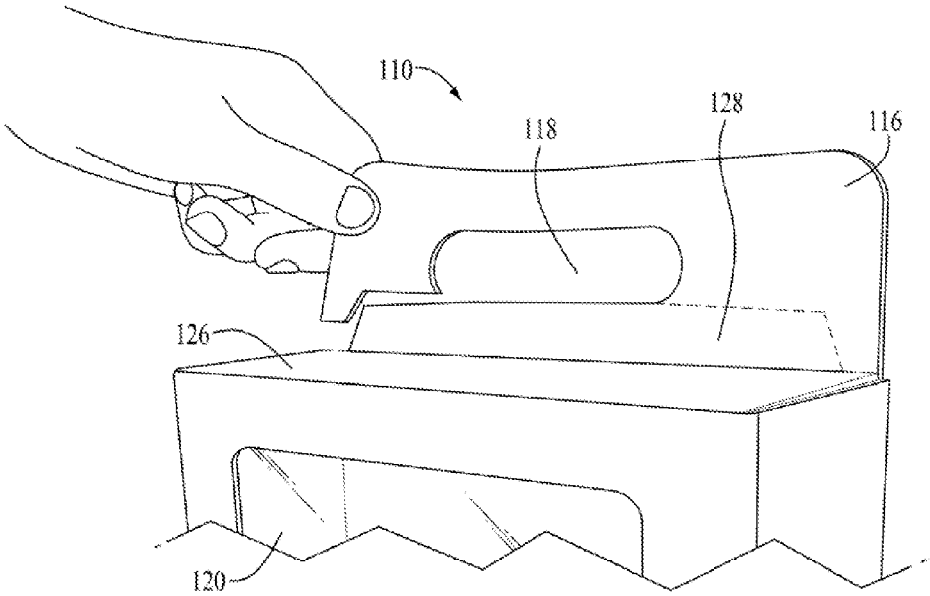
FIG. 9 is a perspective view of a box with a detachable handle, with the rear tab being removed.

Referring to FIGS. 8 and 9, a user adapting the box to a handle-less configuration is shown. In order to remove the handle 112, a user preferably holds the box 110 in one hand and tears off the front tab 114 along the perforation 122. Removing the from tab 114 creates a clean break along the crease line 124 between the front tab 114 and top panel 126 of the enclosure 136. Once the front tab 114 is removed, the user then tears off the rear tab 116 along the perforation 122. Removing the rear tab 116 creates a flap 128, which can be folded and tucked into the box 110. Also, to aid in removing the rear tab 116, the perforations may run into the handle 112, thereby creating a portion that simply pulls away from the box 110. Also, removal of the tabs may be done in any order, or simultaneously as desired.

Figure 10:
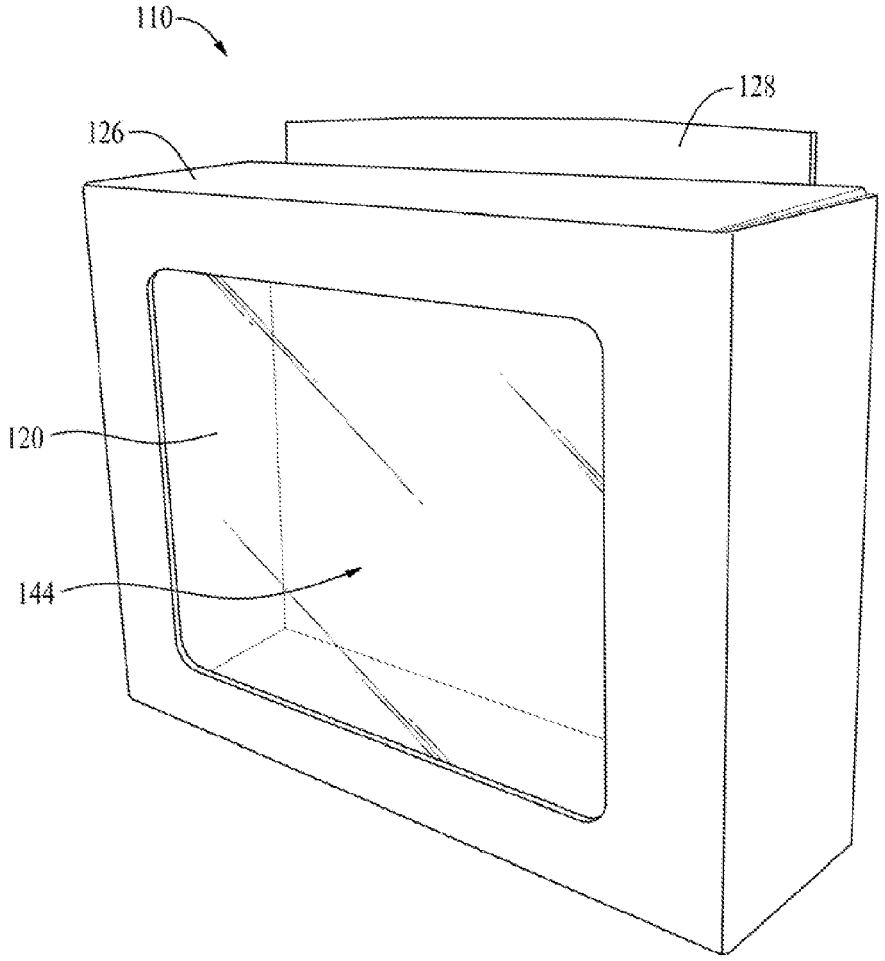
FIG. 10 is a perspective front view of a box with the handle removed.
Figure 11:
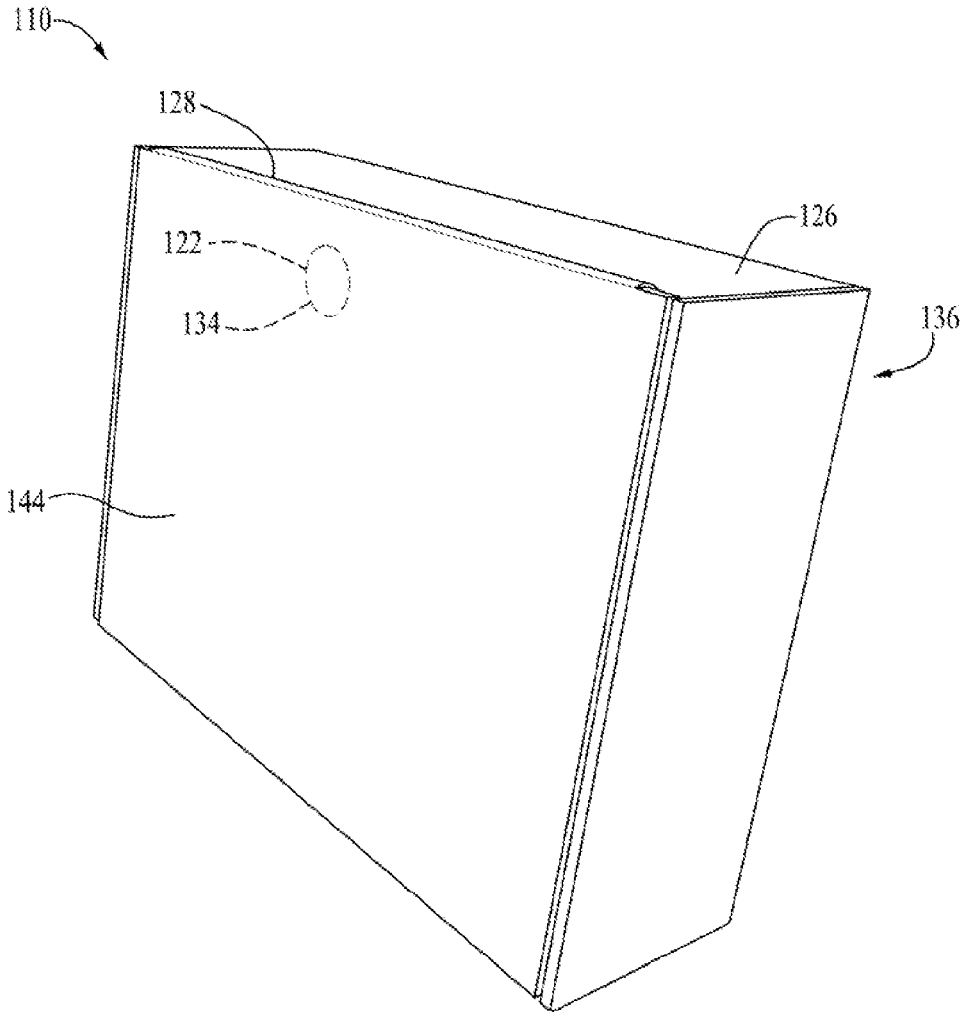
FIG. 11 is a perspective rear view of box with the handle removed and a flap inserted into the enclosure to close the box.
Figure 12:
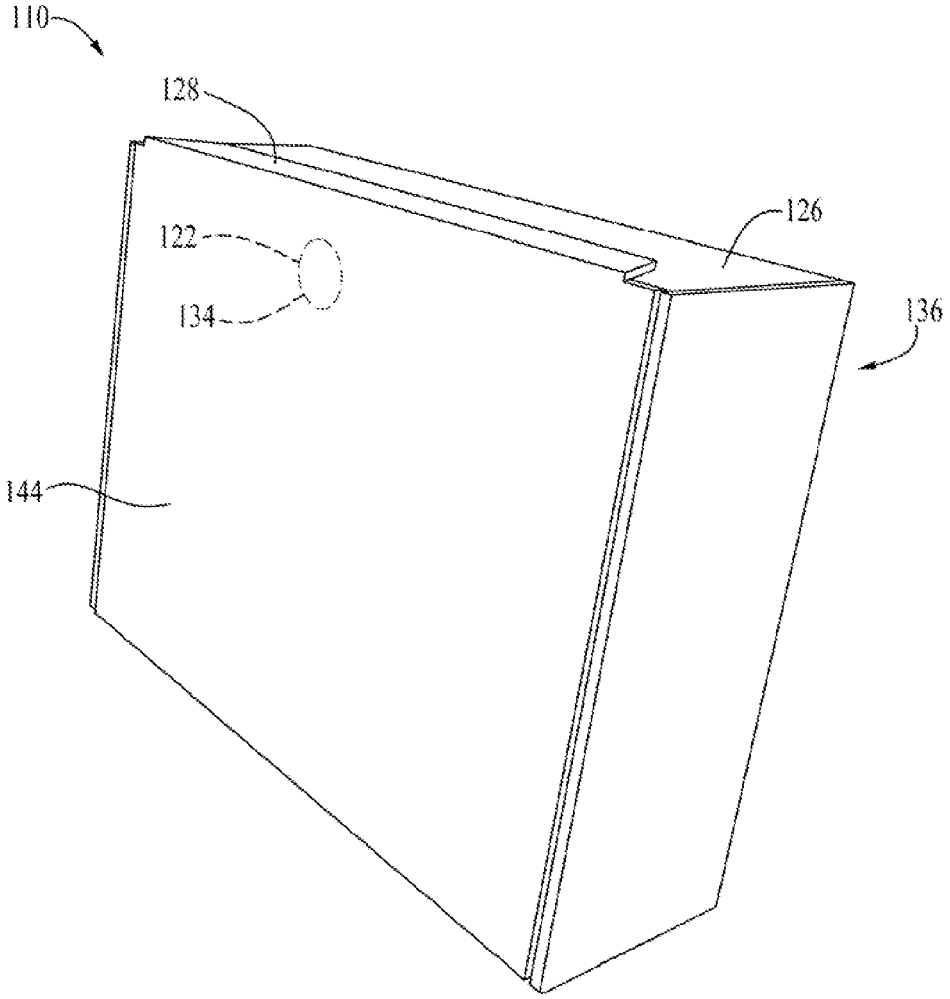
FIG. 12 is a perspective rear view of the box with the handle removed and a flap inserted over the top of the enclosure.

Referring to FIG. 10, a front view the box 110 with the handle (not shown) removed is shown. Once the front tab 114 (not shown) and rear tab 116 (not shown) are removed, the flap 128 remains as a portion of the central panel 144, which is visible through the window 120. Referring to FIG. 11, with the front tab 114 and rear tab 116 removed, the flap 128 may be folded relative to the central panel 144 and tucked into the box 110. With the flap 128 and side flaps 146 (not shown) tucked into the box, they hold the central panel 144 against the enclosure 136, thereby creating a traditional six-sided box, which is suitable for convenient storage and stacking with other, similarly sized boxes. FIG. 12 shows an alternative embodiment wherein the flap 128 is folded over the enclosure. To hold the box closed in this embodiment, the flap 128 may include an adhesive (not shown).

In order to open the box, a user may puncture the central panel 144 with a finger to create a finger hole 134 at the perforations 122. In this manner the box may be easily opened and closed for future use. In one embodiment, the box 110 may have indicia 148 printed on its exterior. Since the box 110 is foldable from a single sheet of cardboard, it may be printed on a single side, avoiding the expense of printing on both sides.

The foregoing description of the preferred embodiment of the Invention is sufficient in detail to enable one skilled in the art to make and use the invention. It is understood, however, that the detail of the preferred embodiment presented is not intended to limit the scope of the invention, in as much as equivalents thereof and other modifications which come within the scope of the invention as defined by the claims will become apparent to those skilled in the art upon reading this specification.

What is claimed is:

1. A box for a product comprising:

a single sheet foldable into an enclosure having an opening, the enclosure sized to receive the product therein through the opening;

the single sheet further having a rear panel foldably connected to the enclosure for covering the opening;

the enclosure having walls, such that the product may be placed inside the enclosure and sealed inside the box;

the enclosure having a first handle member removably attached along a first perforated portion proximate a top panel of the enclosure; and the rear panel having a corresponding second handle member removably attached along a second perforated portion to the rear panel, at least one of said handle members defining a handle aperture, the first and second perforated portions being at least partially unaligned with one another, at least one of the first and second perforations extending to said handle aperture defined by one of the first and second handle members; and the corresponding handle members being glued together;

wherein upon the handle members being removed from the box, a flap overhanging the enclosure remains.

2. The box of claim 1 wherein the flap extends over the top panel.

3. The box of claim 1 wherein the single sheet is made of corrugated cardboard.

4. The box of claim 1 wherein the first handle member and second handle member each include corresponding cut-out portions sized to accept a purchaser's fingers.

5. The box of claim 1 wherein portions of the first handle member and second handle member are crushed together.

6. The box of claim 1 wherein the enclosure includes a window for displaying the product.

7. The box of claim 1 wherein the rear panel includes a finger hole for pulling open the box.

8. A box for a product comprising:

a folding enclosure portion foldably connected to a rear panel formed from a single cardboard sheet;

a window in the folding enclosure portion for viewing the product;

a front handle portion extending from the enclosure portion, and a rear handle portion extending from the rear panel;

wherein the front and rear portions of the handle are adhered together, at least one of said handle portions defining a handle aperture; and wherein the handle portions are detachable from the box respectively along first and second perforated portions at least partially unaligned with one another, at least one of the first and second perforations extending to said handle aperture defined by one of the handle portions, a flap thereby remaining on the rear panel for tucking into the enclosure portion.

9. The box of claim 8 further comprising perforations between the detachable handle portions and the box.

* * * * *